US005592887A

United States Patent [19]

Teng

[11] Patent Number: 5,592,887

[45] Date of Patent: Jan. 14, 1997

[54] ARTICLE ORGANIZING SHELF FRAME

[76] Inventor: Shih-Chin Teng, No. 58, Sec. 1, Shenlin Road, Taya Hsiang, Taichung Hsien, Taiwan

[21] Appl. No.: 554,497

[22] Filed: Nov. 7, 1995

[51] Int. Cl.[6] ..... A47B 3/00

[52] U.S. Cl. ..... 108/134; 211/149; 108/163

[58] Field of Search ..... 108/53.5, 35, 134, 108/163, 166, 179, 181, 190; 312/258; 211/149, 188, 194

[56] References Cited

U.S. PATENT DOCUMENTS

| | | | |
|---|---|---|---|
| 776,282 | 11/1904 | Weston | 108/163 |
| 3,506,138 | 4/1970 | Travis | 108/190 |
| 3,908,562 | 9/1975 | Wittschen | 108/163 |
| 4,226,190 | 10/1980 | Ashton | 211/149 |
| 5,257,701 | 11/1993 | Edelson | 108/134 |

*Primary Examiner*—Peter M. Cuomo

*Assistant Examiner*—Gerald Anderson

*Attorney, Agent, or Firm*—Robert L. Tucker

[57] ABSTRACT

An article organizing shelf frame includes a lower unit adapted to be placed on for example ground and an upper unit detachably mounted on the lower unit. The lower unit has two first rear legs to each of which a first side frame comprising a front leg is pivoted to be rotatable between an expanded position and a stowed position. A first article support member is disposed between the first side frames and pivoted to the first rear legs to be movable between an expanded position and a stowed position. The upper unit has two second rear legs having reduced lower sections to be fit into holes formed on the first rear legs of the lower unit. Two second side frames are respectively pivoted to the second rear legs to be rotatable between an expanded position and a stowed position and each having a second front leg dimensioned to be supported on the respective first front leg. Two article support members are arranged between the second side frames and pivoted to the second rear legs to be rotatable between an expanded position and a stowed position.

17 Claims, 9 Drawing Sheets

ARTICLE ORGANIZING SHELF FRAME

FIELD OF THE INVENTION

The present invention relates generally to an article organizing shelf frame structure and in particular to a detachable and foldable frame structure.

BACKGROUND OF THE INVENTION

Structures for supporting or organizing articles are known, such as bookshelf or cupboard. Such article organizing structures usually comprise fixed configuration so that the space needed and the function provided thereby are fixed, not allowing the users to change as they wish. It is thus desirable to provide an article organizing shelf structure which allows a user to modify the overall configuration to serve different purposes and to fold the whole structure to reduce storage space.

SUMMARY OF THE INVENTION

The principal object of the present invention is thus to provide an article organizing shelf frame structure of which the upper half is separable from the lower half so as to provide two individual shelf units.

It is a further object of the present invention to provide an article organizing shelf frame structure of which the parts are detachable so as to provide a more versatile and user modifiable structure.

It is another object of the present invention to provide an article organizing shelf frame structure comprising two separable units, each being capable to be further dissembled in order to facilitate storage and transportation.

To achieve the above objects, in accordance with the present invention, there is provided an article organizing shelf frame structure comprising a lower unit adapted to be placed on for example ground and an upper unit detachably mounted on the lower unit. The lower unit has two first rear legs to each of which a first side frame comprising a front leg is pivoted to be rotatable between an expanded position and a stowed position. A first article support member is disposed between the first side frames and pivoted to the first rear legs to be movable between an expanded position and a stowed position. The upper unit has two second rear legs having reduced lower sections to be fit into holes formed on the first rear legs of the lower unit. Two second side frames are respectively pivoted to the second rear legs to be rotatable between an expanded position and a stowed position and each having a second front leg dimensioned to be supported on the respective first front leg. Two article support members are arranged between the second side frames and pivoted to the second rear legs to be rotatable between an expanded position and a stowed position.

BRIEF DESCRIPTION OF THE DRAWINGS

The present invention will be better understood from the following description of preferred embodiments thereof, with reference to the attached drawings, wherein.

DETAILED DESCRIPTION OF THE PREFERRED EMBODIMENT

Figure 1:
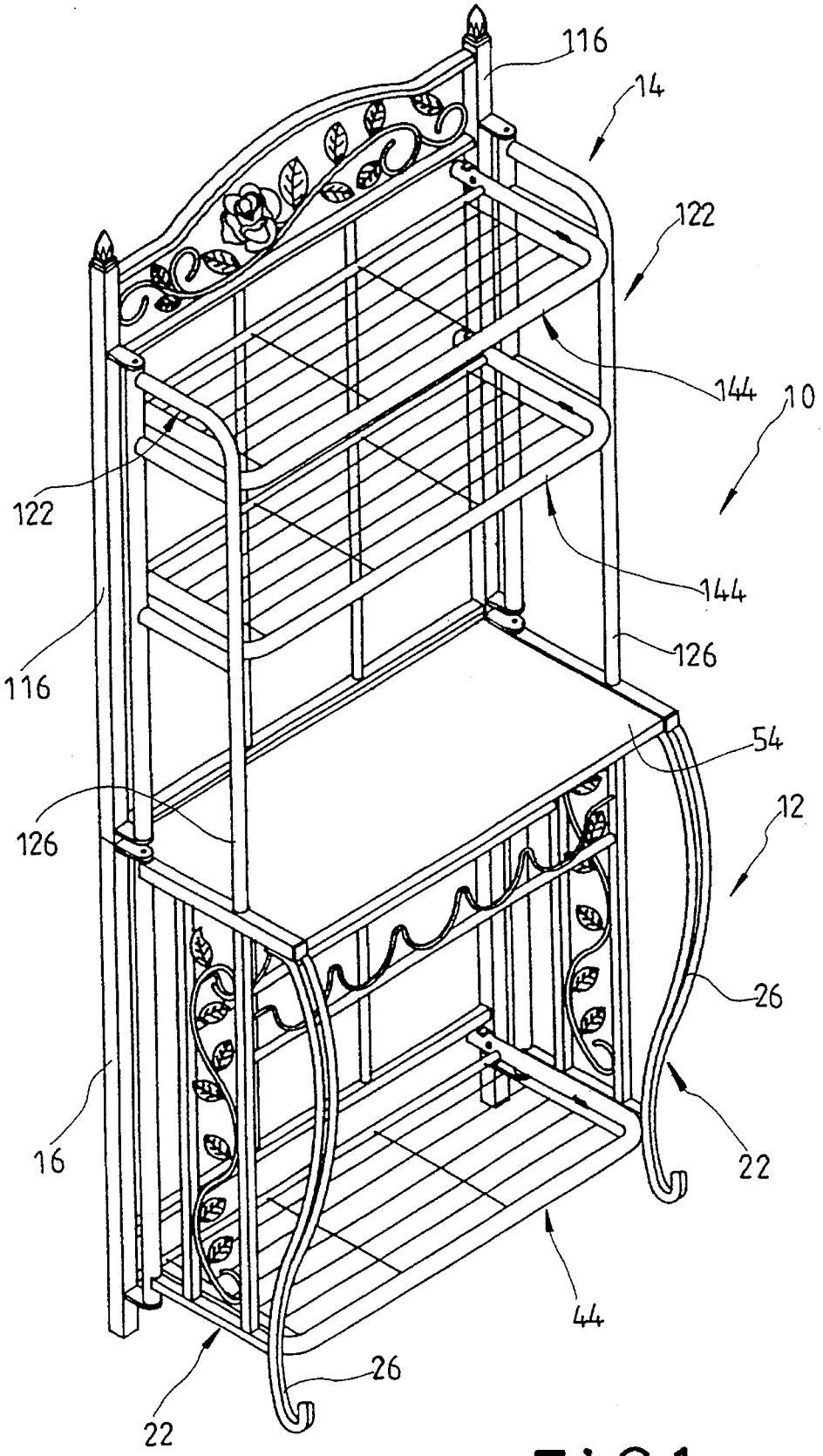
FIG. 1 is a perspective view showing an article organizing shelf frame structure in accordance with the present invention.
Figure 2:
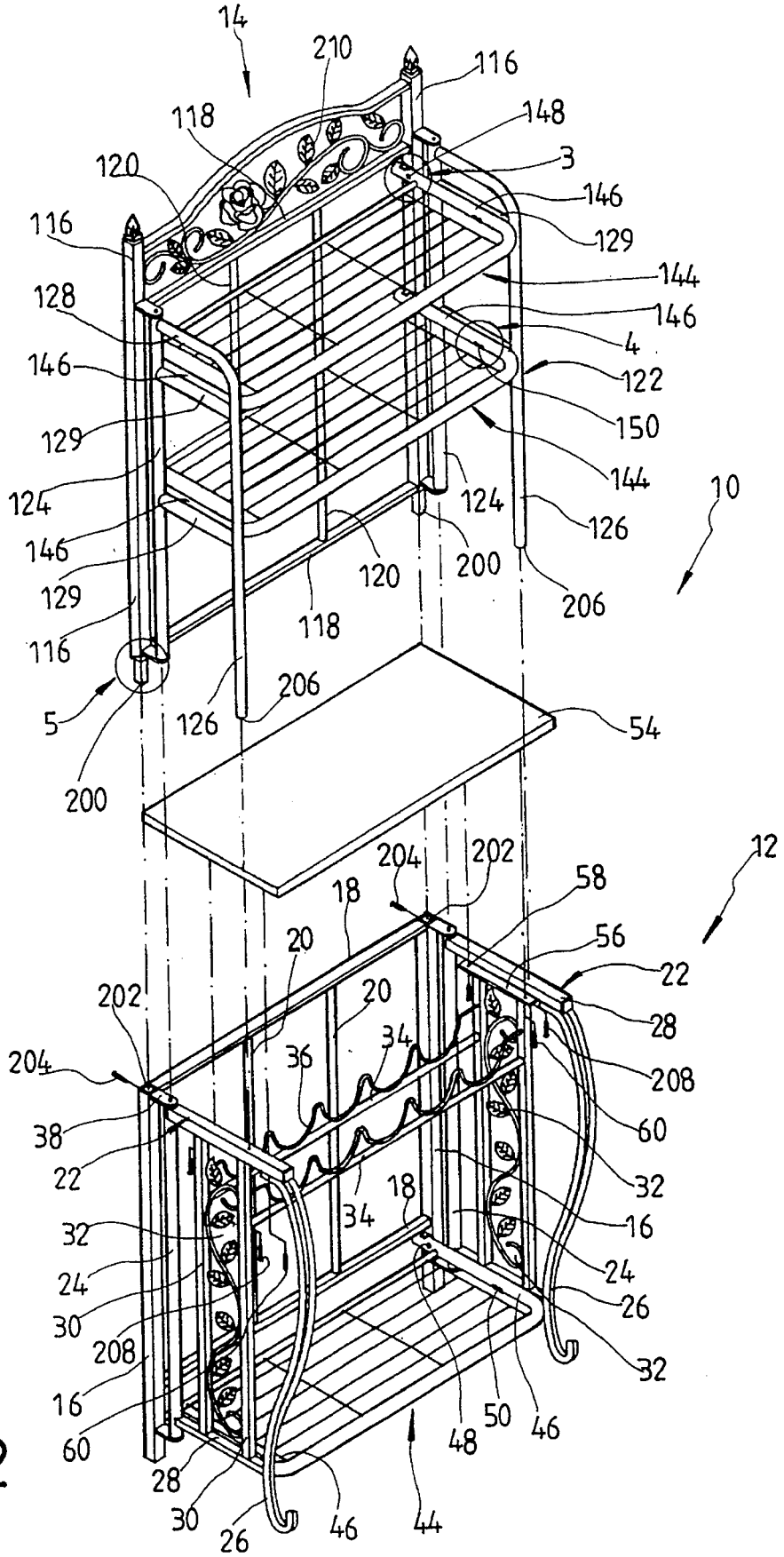
FIG. 2 is an exploded perspective view showing the article organizing shelf frame structure of the present invention.

With reference to the drawings and in particular to FIGS. 1 and 2, wherein an article organizing shelf frame constructed in accordance with the present invention, generally designated with the reference numeral 10, is shown, the article organizing shelf frame 10 comprises a lower unit 12 to be supported on ground and an upper unit 14 disposed on and mounted to the lower unit 12 in a detachable manner.

The lower unit 12 comprises two upright rear legs 16, spaced from and substantially parallel to each other with two horizontally-extending bars 18 extending between and connected the two upright rear legs 16, a rear plane being defined by the rear legs 16 and the horizontally-extending bars 18. The horizontally-extending bars 18 are spaced from and running parallel with each other with two upright bars 20 connected therebetween. The bars 20 are spaced from each other and substantially parallel with the upright rear legs 16.

Figure 6:
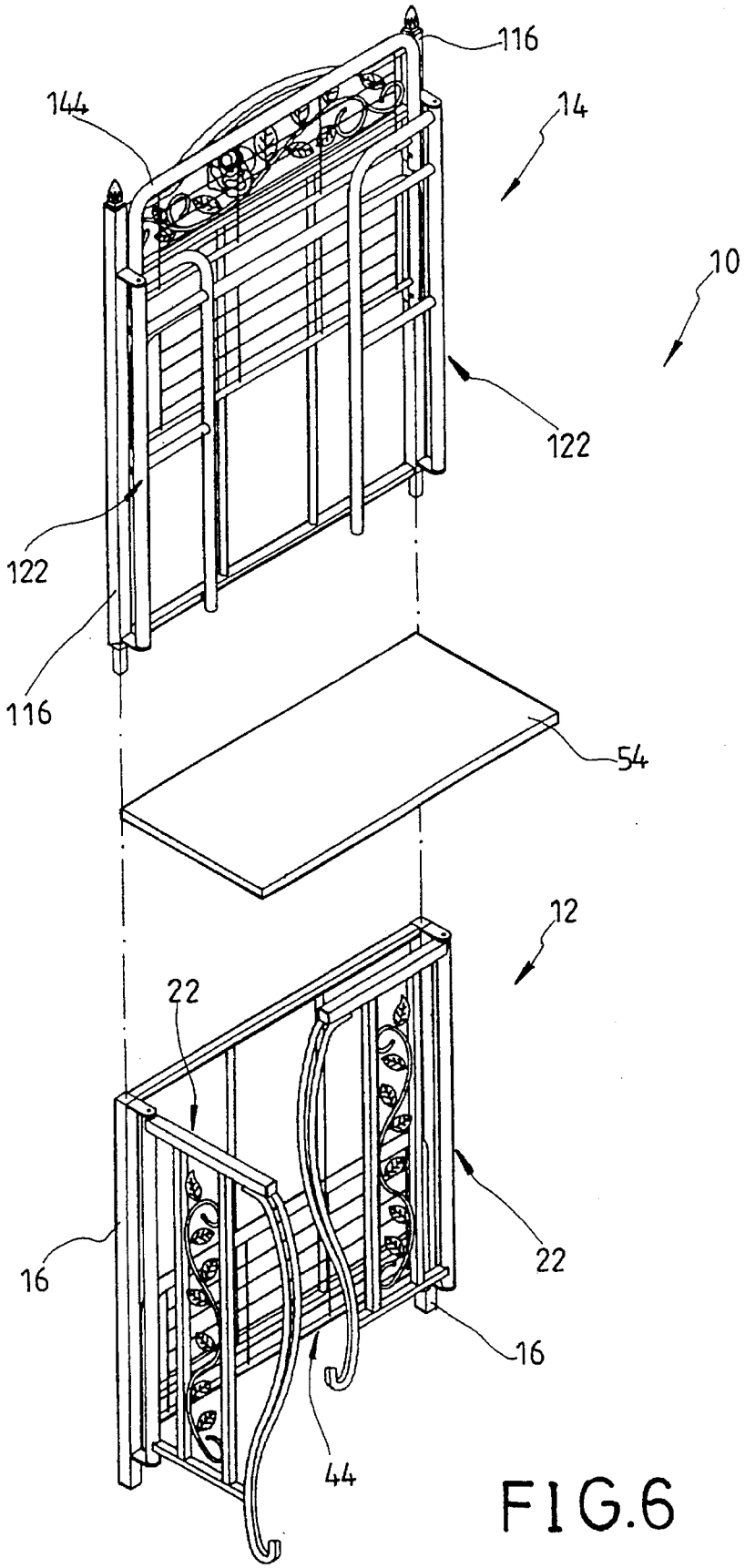
FIG. 6 is an exploded perspective view showing the article organizing shelf frame structure of the present invention in a partially folded condition.

A side frame 22 in the form of a plane structure is pivotally connected to each of the rear legs 16 to extend in a frontward direction normal to the rear plane, defining a side plane spaced from and substantially parallel with each other. Each of the side frame 22 comprises an upright post 24 connected to the respective rear leg 16 with pivoting means and parallel therewith and a front leg 26 arranged in front of the upright post 24 and spaced therefrom with two horizontally-extending braces 28 connected therebetween. The pivot connection between the side frames 22 and the rear legs 16 allows the side frames 22 to be rotated relative to the rear legs 16 to be substantially overlapping the rear plane as shown in FIG. 6 in which only one of the side frames 22 is demonstrated to overlap the rear plane.

The front legs 26 and the rear legs 16 together support the lower unit 12 on ground.

To provide decoration, the front legs 26 may assume a curved shape, as shown in the drawings, rather than a straight elongated rod standing on ground.

Two upright rods 30 are connected between the two braces 28 of each of the side frames 22. Preferably, a decoration pattern 32 may be formed between the two upright rods 30.

Figure 8:
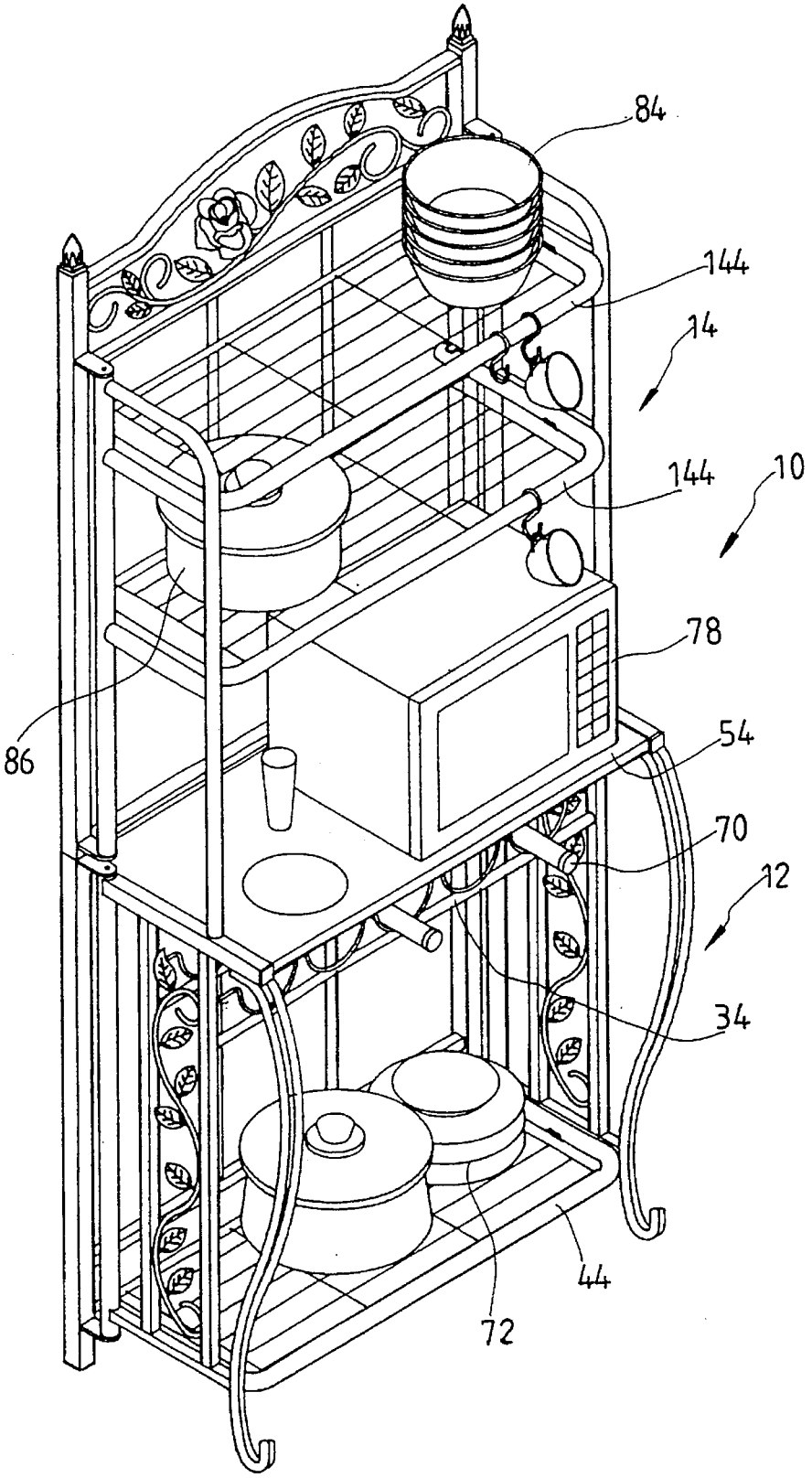

Each of the upright rods 30 of each of the side frames 22 has a rail 34 extending therefrom to connect to the opposite upright rod 30 of the other side frame 22 with a plurality of substantially semi-circular recess 36 formed thereon for hanging or supporting articles thereon, such as 70 in FIG. 8. The rails 34 may be releasably connected between the side frames 22 in order to allow the side frames 22 to rotate relative to the rear plane, as shown in FIG. 6.

Figure 5:
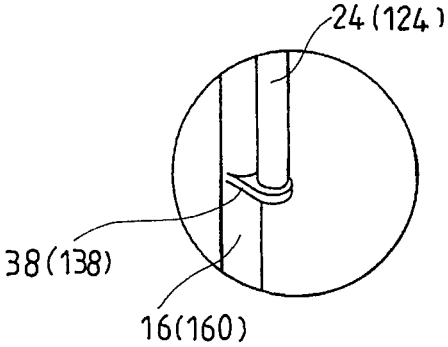
FIG. 5 is an enlarged view of a circled portion of the article organizing shelf frame structure indicated at 5 in FIG. 2.
Figure 5A:
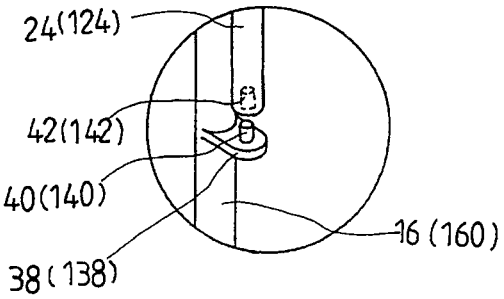
FIG. 5A is also an enlarged view of the circled portion 5 of 2, but showing the portion in the detached condition.

The pivoting means that pivots each of the side frames 22 to the rear legs 16 comprise two elongated tabs 38 (also see FIGS. 5 and 5A) extending from each of the rear legs 16 in a horizontal and frontward direction and spaced from each other a distance substantially corresponding to length of the respective upright post 24 to receive the post 24 therebetween. Each of the tabs 38 has a pin 40 (FIG. 5A) formed thereon to extend toward each other for rotatably fitting into a hole 42 formed on an adjacent end of the post 24.

A lower article support member 44 in the form of rectangular frame having inner net structure is arranged between the side frames 22 having two side bars 46 respectively pivoted to the rear legs 16 at 48 so as to be rotatable relative to the rear plane between an expanded position where the lower article support member 44 extends substantially horizontally and normal to the side frames 22 (as shown in FIG. 1) and a stowed position where the lower article support member 44 is substantially overlapping the rear plane.

Figure 4:
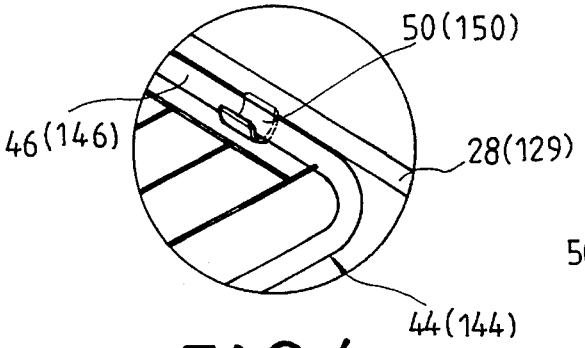
FIG. 4 is an enlarged view of a circled portion of the article organizing shelf frame structure indicated at 4 in FIG. 2.
Figure 4A:
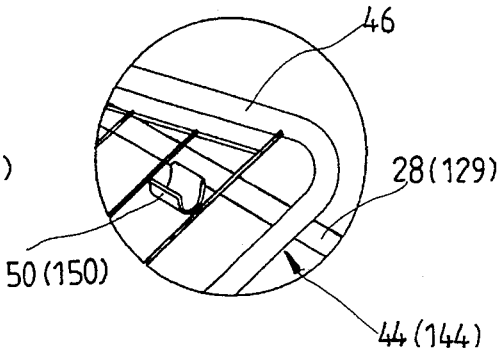
FIG. 4A is also an enlarged view of the circled portion 4 of FIG. 2, but showing the portion in the detached condition.
Figure 7:
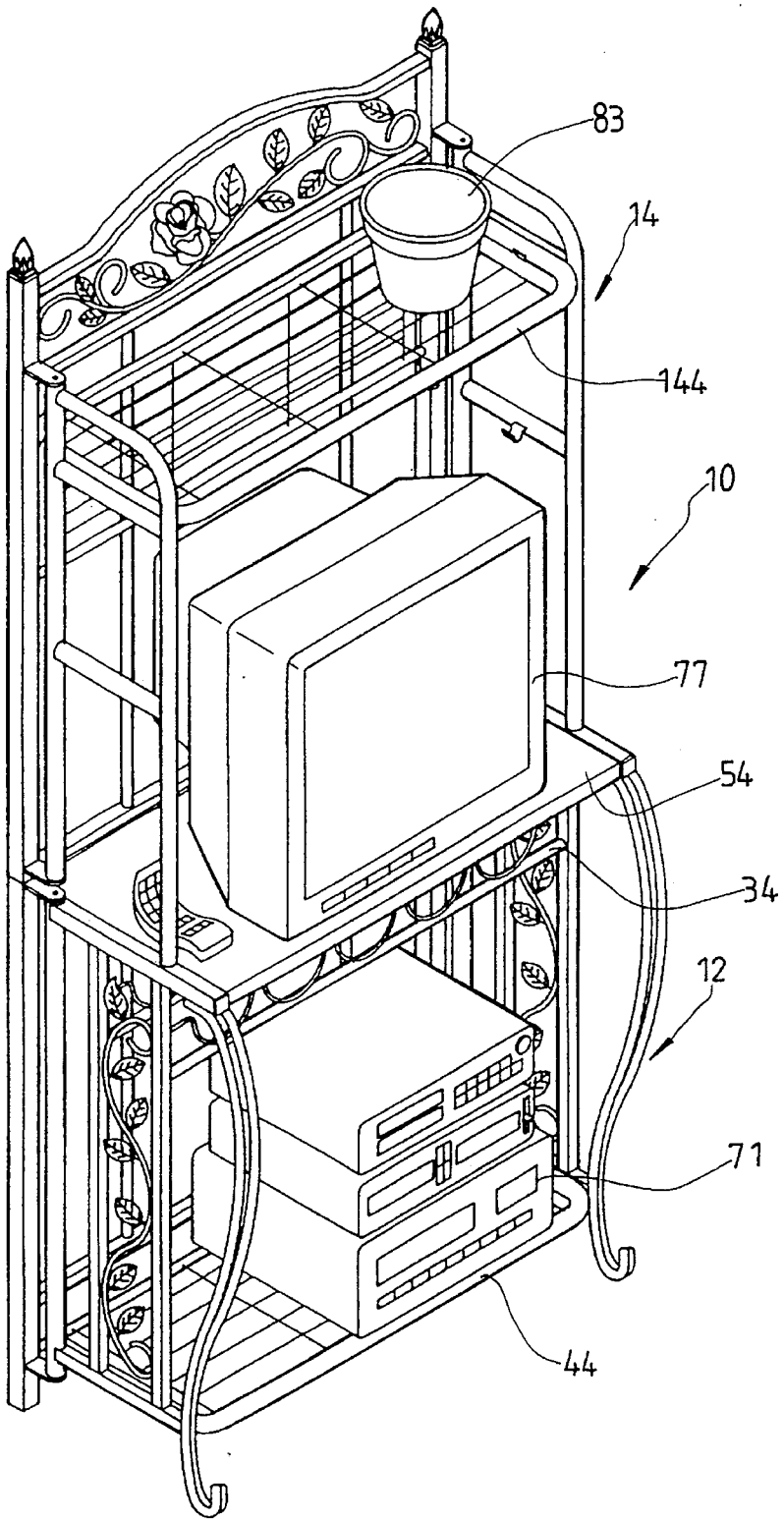
FIGS. 7–10 are perspective views showing different applications of the article organizing shelf frame structure of the present invention.
Figure 9:
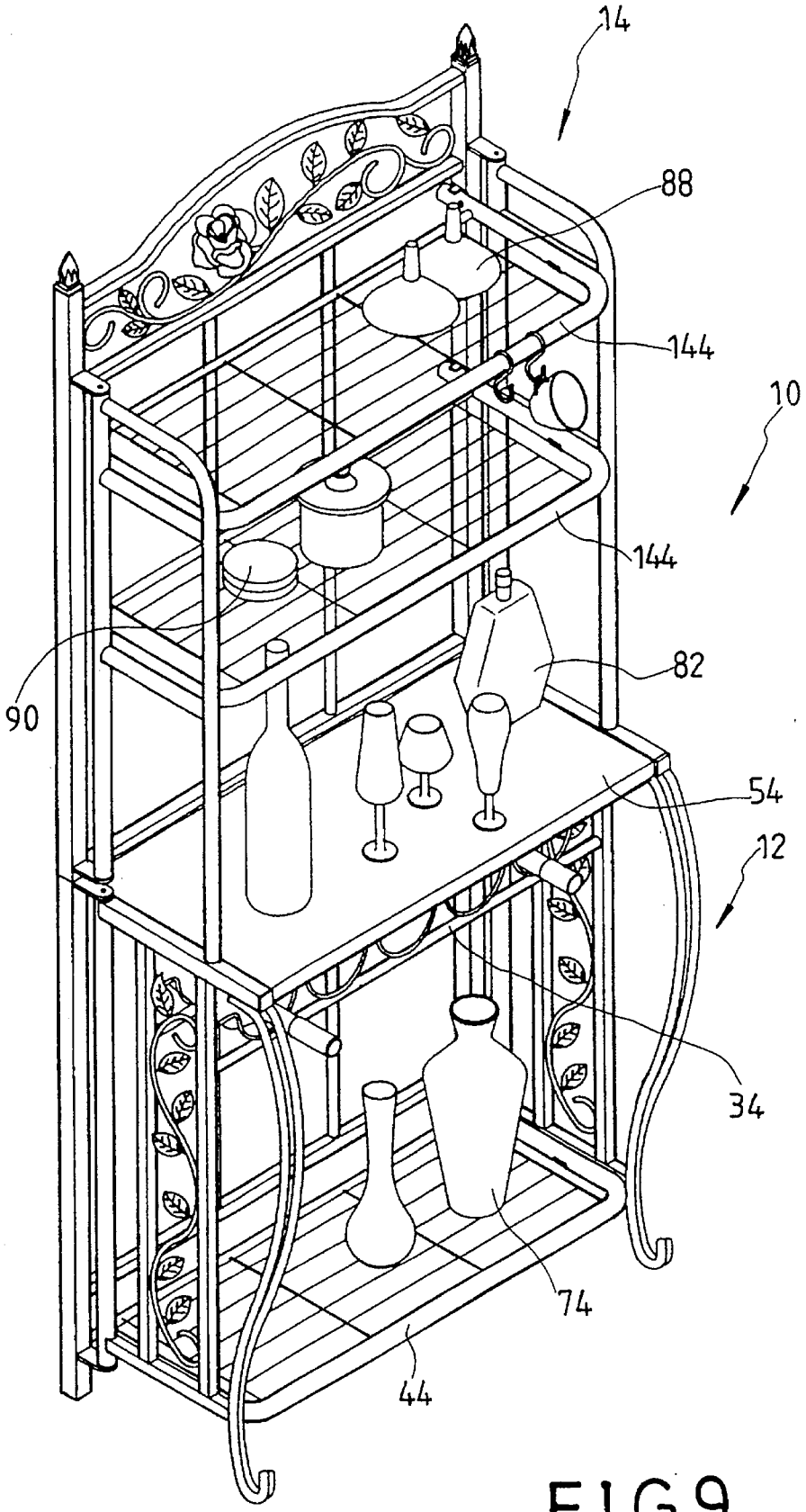
Figure 10:
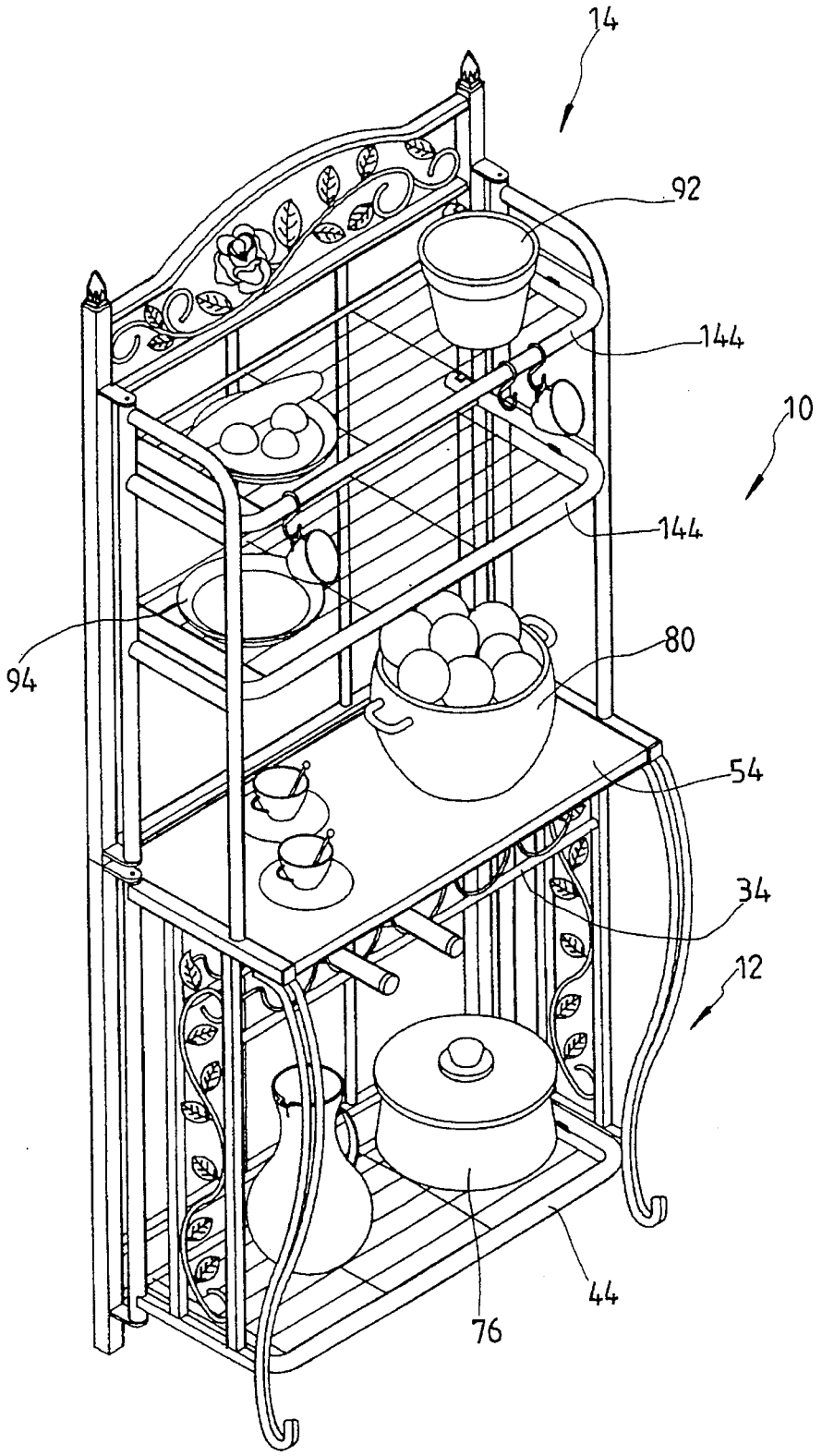

Retaining means is provided to retain the lower article support member 44 at the expanded position to support article thereon, such as 71 in FIG. 7, 72 in FIG. 8, 74 in FIG. 9 and 76 in FIG. 10, which retaining means comprises a support tab 50 (also see FIGS. 4 and 4A) attached to each of the two braces 28, preferably in a concave configuration for holding and supporting the respective side bar 46 of the lower article support member 44, as shown in FIG. 4. The rotatability of the lower article support member 44 relative to the rear legs 16 allows the lower article support member 44 to move out of the concave tab 50, as shown in FIG. 4A.

Figure 3:
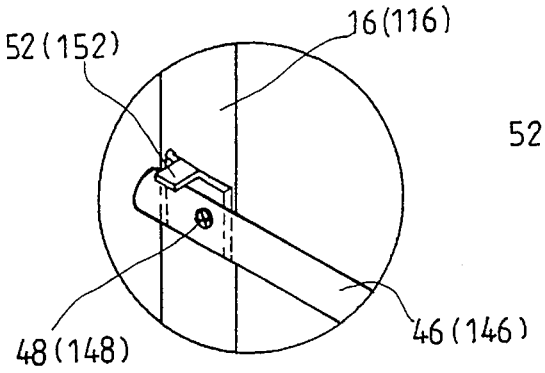
FIG. 3 is an enlarged view of a circled portion of the article organizing shelf frame structure indicated at 3 in FIG. 2.
Figure 3A:
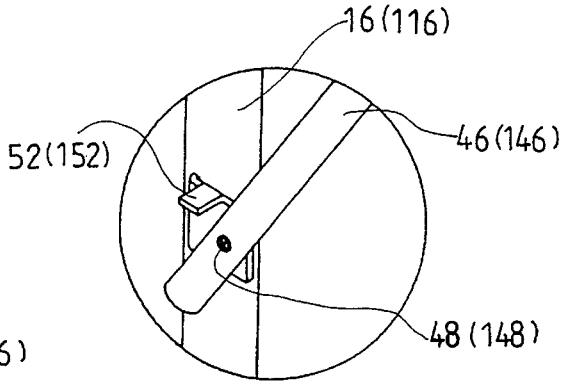
FIG. 3A is also an enlarged view of the circled portion 3 of FIG. 2, but showing the portion in the detached condition.

The retaining means further comprises a stop member 52 (also see FIG. 3 and 3A) which stop the rotation of the side bar 46 of the lower article support member 44 relative to the rear legs 16 when the lower article support member 44 reaches the expanded position, as shown in FIG. 3, but it does not interfere with the rotation of the lower article support member 44 away from the expanded position to the stowed position, as shown in FIG. 3A.

The lower unit 12 further comprises an article support plate 54 releasably mounted between the braces 28 of the side frames 22 by providing an inward flange 56 on each of the braces 28 to support the article support plate 54 thereon, screw holes 58 being provided on each of the inward flanges 56 to releasably secure the article support plate 54 to the side frames 22 with screws 60. The article support plate 54 serves to support articles thereon, such as 77 in FIG. 7, 78 in FIG. 8, 80 in FIG. 9 and 82 in FIG. 10.

The upper unit 14 also has two rear legs 116 with two horizontally-extending bars 118 extending between and connected the two upright rear legs 116, a second rear plane being defined by the rear legs 116 and the horizontally-extending bars 118. The horizontally-extending bars 118 are spaced from and running parallel with each other with two upright bars 120 connected therebetween. The bars 120 are spaced from each other and substantially parallel with the upright rear legs 116.

A side frame 122 in the form of a plane structure is pivotally connected to each of the rear legs 116 to extend in a frontward direction normal to the second rear plane, defining a side plane spaced from and substantially parallel with each other. Each of the side frames 122 comprises an upright post 124 connected to the respective rear leg 116 with pivoting means and parallel therewith and a front leg 126 arranged in front of the upright post 24 and spaced therefrom with a horizontally-extending brace 128 connected at a top end of the front leg 126 and the respective rear leg 116.

The pivoting means that pivots each of the upper side frames 122 to the upper rear legs 116 to allow the upper side frames 122 to be rotated relative to the upper rear legs 116 to be substantially overlapping the upper rear plane as shown in FIG. 6 comprises two elongated tabs 138 (also see FIGS. 5 and 5A) extending from each of the upper rear legs 116 in a horizontal and frontward direction and spaced from each other a distance substantially corresponding to length of the respective upright post 124 to receive the post 124 therebetween. Each of the tabs 138 has a pin 140 (FIG. 5A) formed thereon to extend toward each other for rotatably fitting into a hole 142 formed on an adjacent end of the post 124.

Two further braces 129 extending frontward from each of the upright posts 124 and substantially parallel with the brace 128 connect to the respective front leg 126.

Each of the rear legs 116 of the upper unit 14 has a reduced lower end section 200 removably received within a hole 202 formed on the corresponding rear leg 16 of the lower unit 12 to joint the upper unit 14 to the lower unit 12. Fasteners 204 may be provided to releasably secure the reduced sections 200 of the upper rear legs 116 to the holes 202 of the lower rear legs 16, such as bolt extending through threaded holes formed on both the upper rear legs 116 and the lower rear legs 16.

The front legs 126 of the upper unit 14 are dimensioned so that when the reduced sections 200 of the upper rear legs 116 are received and secured within the holes 202 of the lower rear legs 16, lower end 206 of each of the upper front legs 126 is resting on the respective horizontally-extending brace 28 of the lower unit 12 so as to firmly support the upper unit 14 on the lower unit 12. Fasteners, such as bolts or screws 208 may be provided to releasably secure the lower ends 206 of the upper front legs 126 on the braces 28 of the lower unit 12.

To provide decoration, a decorative pattern 210 may be provided between top ends of the upper rear legs 116.

Two upper article support members 144 are provided between the two upper side frames 122, each having two side bars 146 respectively pivoted to the upper rear legs 116 at 148 to be rotatable relative the second rear plane between an expanded position where the upper article support member 144 extends substantially horizontally and normal to the upper side frames 122 (as shown in FIG. 1) to support articles, such as 83 in FIG. 7, 84 and 86 in FIG. 8, 88 and 90 in FIG. 9 and 90 and 92 in FIG. 10, thereon and a stowed position where the upper article support member 144 is substantially overlapping the second rear plane.

Retaining means is provided to retain each of the upper article support members 144 at the expanded position, which retaining means is substantially similar to the retaining means of the lower unit and comprises a support tab 150 (also see FIGS. 4 and 4A) attached to each of the further braces 129, preferably in a concave configuration for holding and supporting the respective side bar 146 of the upper article support members 144, as shown in FIG. 4. The rotatability of the upper article support members 144 relative to the upper rear legs 116 allows the upper article support members 144 to move out of the concave tabs 150, as shown in FIG. 4A.

The retaining means for the upper unit 12 also comprises stop members 152 (also see FIG. 3 and 3A) which stop the rotation of the side bars 46 of the upper article support members 144 relative to the upper rear legs 116 when the upper article support members 144 reach the expanded positions, as shown in FIG. 3, but they do not interfere with the rotation of the upper article support members 144 away from the expanded positions to the stowed positions, as shown in FIG. 3A.

Figure 11:
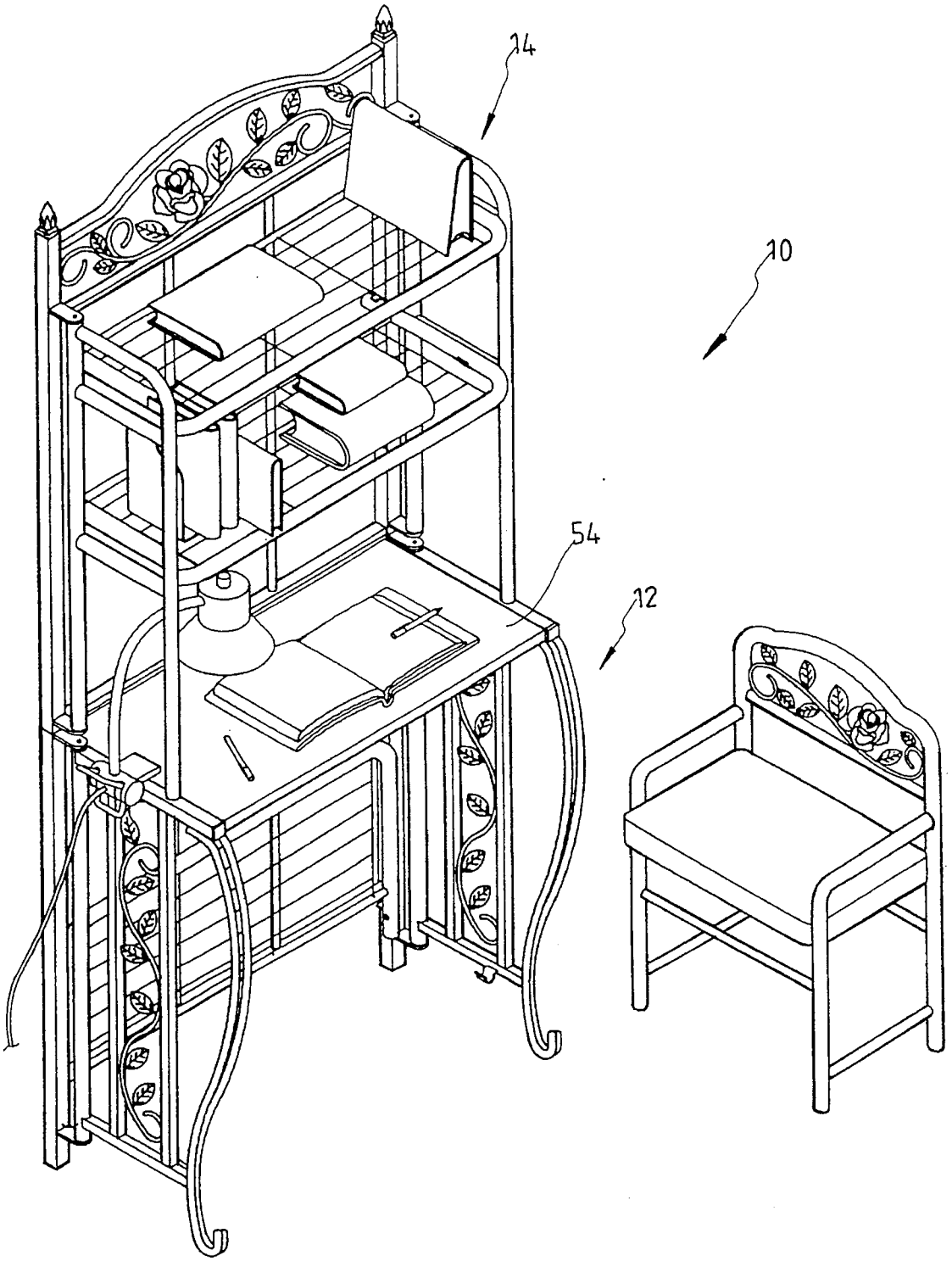
FIG. 11 is a perspective view showing a further application of the article organizing shelf frame structure of the present invention as a desk.

The article organizing shelf frame constructed in accordance with the present invention can be used in a variety of applications, such as those illustrated in FIGS. 7–10 in which the article organizing shelf frame 10 is used to support articles or electrical appliances thereon. A further application of the article organizing shelf frame 10 is illustrated in FIG. 11 in which the frame 10 is user-modified to serve as a desk.

Although preferred embodiments have been described to illustrate the present invention, it is apparent that changes and modifications in the specifically described embodiments can be carried out without departing from the scope of the invention which is intended to be limited only by the appended claims.

What is claimed is:

1. An article organizing shelf frame structure comprising:

a lower unit comprising:

two first rear legs extending vertically and spaced from each other with a first rear frame connected therebetween, a first side frame pivoted to each of the first rear legs to be substantially parallel with and spaced from each other, each of the first side frames having a first front leg dimensioned to cooperate with the rear legs for supporting the lower unit on a surface, at least one first article support member having two side members respectively pivoted to the first rear legs to be rotatable relative to the first rear legs between an expanded position where the first article support member is substantially horizontal and a stowed position where the first article support member is substantially overlapping the rear frame, and retaining means for retaining the first article support member at the expanded position; and an upper unit detachably mounted on the lower unit and comprising:

two second rear legs extending vertically and spaced from each other with a second rear frame connected therebetween, each of the second rear legs corresponding to one of the first rear legs and having a reduced lower section receivable within a hole formed on the respective first rear leg to releasably connect the upper unit to the lower unit, a second side frame pivoted to each of the second rear legs to be substantially parallel with and spaced from each other, each of the second side frames having a second front leg dimensioned to be supported on the one of the first side frames of the lower unit, at least one second article support member having two side members respectively pivoted to the second rear legs to be rotatable relative to the second rear legs between an expanded position where the second article support member is substantially horizontal and a stowed position where the second article support member is substantially overlapping the rear frame, and retaining means for retaining the second article support member at the expanded position.

2. The article organizing shelf frame structure as claimed in claim 1, wherein each of the first side frames comprises two spaced, horizontally-extending braces pivoted to the respective first rear leg with the first front leg connected thereto.

3. The article organizing shelf frame structure as claimed in claim 2, wherein the first side frame comprises two vertical bars connected between the horizontally-extending braces to hold therebetween a decorative pattern.

4. The article organizing shelf frame structure as claimed in claim 1, wherein the lower unit further comprises at least one horizontally-extending rail extending between and releasably secured to the two first side frames with a plurality of semi-circular recesses formed thereon.

5. The article organizing shelf frame structure as claimed in claim 4, wherein the lower unit comprises two horizontally-extending rails releasably secured between the first side frames, each of the rails having a plurality of semi-circular recesses formed thereon.

6. The article organizing shelf frame structure as claimed in claim 1, wherein the first front legs have a curved configuration.

7. The article organizing shelf frame structure as claimed in claim 1, wherein the lower unit further comprises an article support plate releasably mounted between the first side frames by means of fasteners.

8. The article organizing shelf frame structure as claimed in claim 7, wherein each of the first side frames comprises an inward flange mounted to one of the horizontally-extending braces for supporting the article support plate thereon, each of the inward flanges having holes formed thereon to allow the fasteners to extend through and releasably engage the article support plate for releasably securing the article support plate on the inward flanges.

9. The article organizing shelf frame structure as claimed in claim 8, wherein the fasteners comprise screws.

10. The article organizing shelf frame structure as claimed in claim 1, wherein each of the first rear legs comprises two spaced, horizontally-extending tabs, each having a pin projecting therefrom to face each other and wherein each of the horizontally-extending braces of each of the first side frames has a hole corresponding to each of the pins to rotatably fit over the pin so as to allow the first side frames to be rotatable relative to the first rear legs.

11. The article organizing shelf frame structure as claimed in claim 1, wherein retaining means of the lower unit comprises a tab mounted to each of the first side frames and located to support one of the side members of the first article support member.

12. The article organizing shelf frame structure as claimed in claim 1, wherein retaining means of the lower unit comprises a stop mounted to each of the first rear legs and located to stop the rotation of the first article support frame relative to the first rear legs when the first article support frame reaches the expanded position.

13. The article organizing shelf frame structure as claimed in claim 1, wherein each of the second rear legs comprises two spaced, horizontally-extending tabs, each having a pin projecting therefrom to face each other and wherein each of the horizontally-extending braces of each of the second side frames has a hole corresponding to each of the pins to rotatably fit over the pin so as to allow the second side frames to be rotatable relative to the second rear legs.

14. The article organizing shelf frame structure as claimed in claim 1, wherein retaining means of the upper unit comprises a tab mounted to each of the second side frames and located to support one of the side members of the second article support member.

15. The article organizing shelf frame structure as claimed in claim 1, wherein retaining means of the upper unit comprises a stop mounted to each of the second rear legs and located to stop the rotation of the second article support frame relative to the second rear legs when the second article support frame reaches the expanded position.

16. The article organizing shelf frame structure as claimed in claim 1, wherein the upper unit comprises two second article support members pivotally connected to the second rear legs.

17. The article organizing shelf frame structure as claimed in claim 1, further comprising bolts extending through a portion of each of the first rear leg on which the hole to receive the reduced lower section of the respective second rear leg there is formed and the reduced lower section of the second rear leg so as to releasably secure the second rear leg to the first rear leg.

* * * * *